US009044761B2

(12) United States Patent
Fuse

(10) Patent No.: US 9,044,761 B2
(45) Date of Patent: Jun. 2, 2015

(54) ELECTROSTATIC SYSTEM AND METHOD OF SORTING PLASTICS

(75) Inventors: Kenichi Fuse, Hadano (JP); Machiko Fuse, legal representative, Hadano (JP)

(73) Assignee: Empire Technology Development LLC, Wilmington, DE (US)

( * ) Notice: Subject to any disclaimer, the term of this patent is extended or adjusted under 35 U.S.C. 154(b) by 271 days.

(21) Appl. No.: 13/819,793

(22) PCT Filed: Aug. 16, 2012

(86) PCT No.: PCT/US2012/051017

§ 371 (c)(1),
(2), (4) Date: Feb. 28, 2013

(87) PCT Pub. No.: WO2014/028012

PCT Pub. Date: Feb. 20, 2014

(65) Prior Publication Data

US 2014/0299517 A1 Oct. 9, 2014

(51) Int. Cl.

| | |
|---|---|
| ***B03C 7/02*** | (2006.01) |
| ***B03C 7/08*** | (2006.01) |
| ***B07B 13/00*** | (2006.01) |

(52) U.S. Cl.
CPC . *B03C 7/023* (2013.01); *B03C 7/08* (2013.01); *B07B 13/003* (2013.01)

(58) Field of Classification Search
CPC ..... B03C 7/003; B03C 7/02; B03C 7/08; B03C 7/023
USPC ..... 209/127.1, 127.3, 128–130
See application file for complete search history.

(56) References Cited

U.S. PATENT DOCUMENTS

| | | | | |
|---|---|---|---|---|
| 2,225,096 | A * | 12/1940 | Bullock | 209/129 |
| 2,300,324 | A | 10/1942 | Thompson | |
| 2,398,792 | A * | 4/1946 | Johnson | 209/127.1 |
| 3,143,492 | A | 8/1964 | Bullock | |
| 3,402,814 | A | 9/1968 | Morel et al. | |
| 3,426,895 | A * | 2/1969 | Bullock | 209/129 |
| 4,326,951 | A * | 4/1982 | Broz | 209/127.4 |
| 5,358,119 | A | 10/1994 | Stahl et al. | |
| 5,746,320 | A * | 5/1998 | Fujita et al. | 209/127.3 |
| 5,829,598 | A | 11/1998 | Whitlock | |
| 6,011,229 | A | 1/2000 | Geisler et al. | |
| 6,323,451 | B1 | 11/2001 | Stencel et al. | |
| 6,426,474 | B1 | 7/2002 | Maechata et al. | |
| 6,452,126 | B1 | 9/2002 | Xiao et al. | |

(Continued)

FOREIGN PATENT DOCUMENTS

EP 1572370 B1 9/2011

OTHER PUBLICATIONS

International Search Report and Written Opinion for PCT/US2012/051017 dated Oct. 23, 2012.

(Continued)

*Primary Examiner* — Joseph C Rodriguez
(74) *Attorney, Agent, or Firm* — Pepper Hamilton LLP

(57) ABSTRACT

Sorting and separation systems may use the inherent electrostatic properties of plastic as the basis for separating different types of plastics from one another. Plastics of different types may charge to different degrees when subjected to a charging event. By appropriately charging a collection unit, plastic components of one type of plastic may be separated from other plastic components by electrostatic attraction.

32 Claims, 5 Drawing Sheets

(56) References Cited

U.S. PATENT DOCUMENTS

| | | | | |
|---|---|---|---|---|
| 6,467,628 | B1 * | 10/2002 | Maehata et al. | 209/12.2 |
| 6,720,514 | B1 | 4/2004 | Inoue et al. | |
| 6,903,294 | B1 | 6/2005 | Daiku et al. | |
| 7,063,213 | B2 | 6/2006 | Allen, III et al. | |
| 7,802,685 | B2 | 9/2010 | Allen et al. | |
| 8,056,728 | B2 | 11/2011 | Riise et al. | |
| 2009/0152173 | A1 | 6/2009 | Miller et al. | |
| 2010/0282647 | A1 | 11/2010 | Miller et al. | |
| 2013/0180891 | A1 * | 7/2013 | Binder et al. | 209/4 |

OTHER PUBLICATIONS

Tonoya et al., Stabilization of characteristics of an electrostatic separation system for PET bottle in the form of flakes, *Bulletin of Tokyo Metropolitan Industrial Technology Research Institute*, (2001), 4:73-76.

* cited by examiner

ELECTROSTATIC SYSTEM AND METHOD OF SORTING PLASTICS

CLAIM OF PRIORITY

This application is a U.S. national stage filing under 35 U.S.C. §371 of International Application No. PCT/US2012/051017, filed 16 Aug. 2012 entitled "Electrostatic System and Method for Sorting Plastics," the disclosure of which is incorporated by reference in its entirety.

BACKGROUND

Plastic is a relatively inexpensive, lightweight and durable material that has become an integral and useful part of our daily lives. Countless different types of products now contain plastic, and virtually every industry uses plastic in some form. However, because plastic is durable, it essentially does not degrade, or degrades very slowly, and therefore accumulates in landfills.

Re-use of resources by collecting and recycling plastics is one of the activities that is being practiced to address global environmental issues. Even though waste discarded from individual households or businesses is separated from other waste so as to collect plastic separately, in practice it is difficult to separate plastic by type at disposal sites. As a result, in order to re-use discarded plastic collected at waste stations, etc., it is necessary to reliably separate a few types of plastic, particularly those having high added value, at a specialized facility, such as a collecting plant. While this has already been practiced for some specific types of plastic, existing methods can be expensive and not appropriate for separation of large quantities of plastics.

There remains a need for separation methods that are capable of separating a large quantity of plastics with high precision and low cost to provide a separation which is acceptable for reuse of the plastics.

SUMMARY

Presently disclosed are systems and methods for sorting of plastic components based on electrostatic charging differences between plastic types. Different plastic types carrying different amounts of electrostatic charge can be separated by electrostatic attraction.

In an embodiment, a system for sorting plastic components includes a charging device for giving each plastic component an electrostatic charge to produce charged components, where each plastic component comprises one of at least three different plastic types, and each plastic type obtains a different charge density than each other plastic type. The system also includes a collection area for collecting charged components of a first plastic type having a lowest charge density, a conveying system for conveying the charged components along a conveyance path extending from the charging device to the collection area, and a plurality of electrostatic collectors disposed in series along the conveyance path, where the number of electrostatic collectors is greater than or equal to one less than the number of plastic types, with each electrostatic collector being charged with an electrostatic charge opposite to the charge given the charged components to attract and adhere the charged components thereto and remove the adhered components from the conveyance path. A first electrostatic collector has an amount of charge configured for attracting charged components of a second plastic type having a highest charge density, and each subsequent electrostatic collector has an amount of charge greater than the charge of a previous electrostatic collector and configured for attracting charged components of an additional plastic type having a next highest charge density.

In an additional embodiment, a method for sorting plastic components includes determining the number and kinds of plastic types of the plastic components, where each plastic component comprises one of at least three different plastic types, and charging each plastic component with an electrostatic charge to produce charged components, where each plastic type charges to a different charge density than each other plastic type. The method also includes conveying the charged components along a conveyance path extending from the charging device to a first collection area, disposing a plurality of electrostatic collectors in series along the conveyance path, the number of electrostatic collectors being greater than or equal to one less than the number of plastic types, and charging each of the plurality of electrostatic collectors with an electrostatic charge opposite to the electrostatic charge given to the charged components and configured as a function of the plastic type to attract the charged components to the electrostatic collectors and adhere the charged components to the electrostatic collectors to remove the adhered components from the conveying device. A first electrostatic collector is charged with an amount of charge configured for attracting charged components of a first plastic type having a highest charge density, and each subsequent electrostatic collector is charged with an amount of charge greater than the charge of a previous electrostatic collector and configured for attracting charged components of an additional plastic type having a next highest charge. The method also includes removing the charged components of the first plastic type from the conveyance path with the first electrostatic collector, removing the charged components of the additional plastic type from the conveyance path with each subsequent electrostatic collector, and collecting components of a second plastic type having the lowest charge density in the first collection area.

DETAILED DESCRIPTION

One way to reduce plastic waste is by recycling, or recovering scrap or waste plastic and reprocessing the material into useful products, sometimes completely different in form from their original state. Making new plastic products from recycled materials uses two-thirds less energy than making products from raw (virgin) materials, and each ton of plastic recycled may save about 5.5 cubic meters of landfill space.

However, in comparison to other materials like glass and metal, the recycling of plastic polymers requires greater processing in the form of processes such as, heat treating, thermal depolymerization and monomer recycling. Due to the high molecular weight of the large polymer chains, plastics typically have a low entropy of mixing. A macromolecule interacts with its environment along its entire length, so the total energy involved in mixing may be large compared to that of other organic molecules with a similar structure. Heating alone may generally not be sufficient to dissolve such large plastics molecules, so plastics must often be of nearly identical composition to mix efficiently for re-use. When different types of plastics are melted together, they tend to phase-separate, like oil and water, and set in these layers. The phase boundaries cause structural weakness in any resulting material. Polymer blends may therefore only be useful in certain applications.

Sorting of recycled plastics into individual plastic types, or at least types which are miscible with one another, may therefore provide for better quality products from recycled plastics. Because of the differences in polymeric make-up of plastics, different types of plastics will be charged to different degrees when exposed to electrifying conditions.

Systems and methods capable of continuously separating and collecting a large quantity of plastic products may selectively separate many different types of collected plastic according to the different electrostatic charging properties of the different types of collected plastics. After applying a charge to the plastic products, various types of plastics will charge to different degrees, and separation of the plastic products may be done by making use of the electrostatic attraction force which will then vary for the various types of collected plastics. Separation of plastics may then be done by charging an electrostatic body in a collecting unit with a pre-determined amount of static electricity and moving the charged plastics past the electrostatic body. Plastic components having an amount of charge sufficient to electrostatically attract the component to the electrostatic body may selectively adhere to the electrostatic body by electrostatic attraction and be carried to an alternate location where they may be deposited into a storage area.

Figure 1:
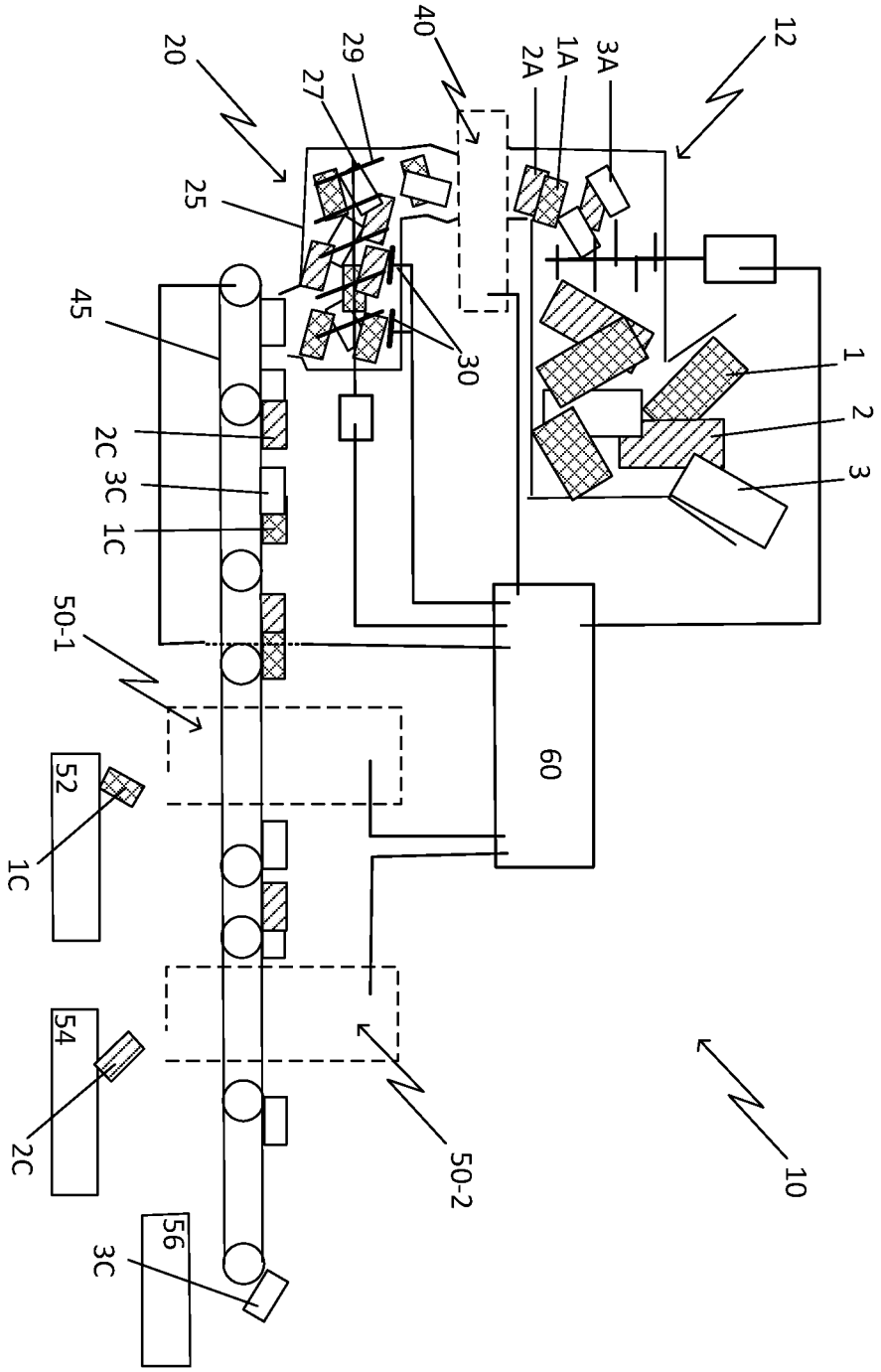
FIG. 1 depicts a system for sorting plastic components according to an embodiment.

Separation and collection methods and systems which take advantage of this difference in charging may be usable for multiple types of plastics that have been discarded and collected. One illustrative example of such a system 10 is depicted in FIG. 1. In an embodiment, it may be desirable to reduce the size of the different plastic components 1, 2, 3 that have been collected for recycling. A plastic separation system 10 may include a shredding or milling unit 12 for cutting or shredding the plastic components 1, 2, 3 into smaller pieces 1A, 2A, 3A. Smaller pieces may require less electrostatic force for subsequent separation.

As an example, the plastic components may be cut into pieces which may have a substantially rectangular shape having a width of from about 0.5 cm to about 10 cm and a length of from about 0.5 cm to about 20 cm, so that an area of the plastic pieces may be from about 0.25 $cm^2$ to about 200 $cm^2$. In a further example, it may be desirable that the plastic be cut into pieces having a width of from about 1 cm to about 4 cm and a length of from about 1 cm to about 4 cm, so that an area of the plastic pieces may be from about 1 $cm^2$ to about 16 $cm^2$. In alternate embodiments, the plastic pieces may have any combination of lengths and widths of about 1 mm, about 5 mm, about 1 cm, about 2 cm, about 3 cm, about 4 cm, about 5 cm, about 6 cm, about 7 cm, about 8 cm, about 9 cm, about 10 cm, about 11 cm, about 12 cm, about 13 cm, about 14 cm, about 15 cm, about 16 cm, about 17 cm, about 18 cm, about 19 cm, about 20 cm a value between any two of the listed values, a range of values defined by any two of the listed numbers, or a range of values defined by any number between any two of the listed values and another number between any two other of the listed values.

In a further embodiment, the pieces may be of alternate shapes, such as circular or irregular shapes, and may have an area of from about 0.01 $cm^2$ to about 400 $cm^2$. In embodiments, the pieces may be comminuted to sizes having an area of about 0.01 $cm^2$, 0.03 $cm^2$, about 0.5 $cm^2$, about 1 $cm^2$, about 2 $cm^2$, about 4 $cm^2$, about 7 $cm^2$, about 10 $cm^2$, about 15 $cm^2$, about 20 $cm^2$, about 30 $cm^2$, about 50 $cm^2$, about 75 $cm^2$, about 100 $cm^2$, about 133 $cm^2$, about 166 $cm^2$, about 200 $cm^2$, about 250 $cm^2$, about 300 $cm^2$, about 350 $cm^2$, about 400 $cm^2$, a value between any two of the listed values, a range of values defined by any two of the listed numbers, or a range of values defined by any two of the listed values or numbers between any of the listed values.

In an embodiment (not shown) the plastic components may not be further reduced in size, and the plastic components 1, 2, 3 may be charged in a charging system 20. Alternatively, as shown, the plastic pieces 1A, 2A, 3A may be charged with any variety of charging device or system 20 that is capable of electrifying the pieces to give the pieces a charge density. One type of charging system 20 may be a frictional charging device in which the pieces 1A, 2A, 3A may be charged by moving and agitating the pieces through a drum 25 with an agitator 27 that includes radially extending arms 29 to cause the pieces to forcibly rub against each other and the components of the drum to acquire an electrical charge. Additional electrical charging inputs 30 may be included to provide an additional charge to the pieces 1A, 2A, 3A if necessary to charge the pieces to an appropriate amount needed for subsequent separation.

Alternative embodiments of charging systems may include contact electrification or discharge electrification. A contact electrification system may be realized by simple mechanical contact, which may be provided by agitation, air blow, circulation and also contact with charging materials such as charged electrodes. As an example, brushing over the plastics with a brush made from polyethylene filament may induce electrification. An example of discharge electrification may be realized by a corona discharge method, such as that used in copy machines or laser printers to charge toner, where a high voltage charge may be applied close to the particles and the corona discharge provides a charge to the particles.

Since the amount of charge per size of the material may affect the ability to separate the plastics based on charge, an embodiment of the separation system 10 may also include a device 40 which allows only pieces of substantially uniform size to move on to the charging system 20. The device 40 may be a screening or sieving system which allows pieces of only predetermined sizes to move on to the charging system 20. Plastic pieces that are too large may be returned to the shredder 12 for a further reduction in size. In an embodiment, size reduction and sorting may be done as processes substantially separate from the separation. For example, plastic components may be shredded and sized upon arrival at a collection site, and then stored in corresponding locations for subsequent sorting at a later time.

Plastic pieces of relative uniformity of size, for example, up to about +/−50% of diameter, may be processed together to provide for an improved separation. For better separation efficiency, separations may be performed with size uniformity variances in diameter of up to about +/−47%, about +/−44%, about +/−41%, about +/−38%, about +/−35%, about +/−32%, about +/−29%, about +/−26%, about +/−23%, about +/−20%, about +/−17%, about +/−14%, about +/−10, or any value between any two of the listed values.

Charged pieces 1C, 2C, 3C may be deposited from the charging system 20 onto a transport system, depicted in FIG. 1 as a conveyor system 45, which may then transport the charged pieces to separation units 50-1, 50-2 for separation of the various plastic components from one another (discussed further below). As an alternative to the conveyor system 45, the transport system may be a track system with moving trays, or any other type of conveying/transport system which may have an insulating surface which prevents discharge of the plastic components. While only two separation units 50-1, 50-2 are shown in FIG. 1, in embodiments, the number of units (50-N) may vary from 1 unit to at least one less than the number of different types of plastic components present when one unit is used for separating each single plastic type. In some embodiments, it may be desirable for one unit to remove two different types of plastic components, for example, two plastics which have similar chargeability and which may be intermixed for producing new products. In alternative embodiments, it may be desirable to have two or more units remove a single type of plastic component, for example, to provide for a higher degree of separation accuracy when a first unit may become overloaded and possibly incapable of separating all pieces of that particular type from the conveyor. The number of separation units may vary in any combination as determined by need and/or desired final outcomes.

The separation units 50-1, 50-2 . . . 50-N may include systems and arrangements (discussed further below) that selectively attract and collect the plastic components from the transport unit so as to selectively separate and collect the separated plastic by making use of an electrostatic attraction force that varies for each type of the plastic. As an example, separation unit 50-1 may remove components 1C of the first plastic type and deposit those components in a collection area 52. Separation unit 50-2 may remove components 2C of the second plastic type and deposit those components in a collection area 54. In the depiction of FIG. 1, the remaining component 3C of the third plastic type may then be transported or deposited in a third collection area 56.

A single control system 60 may be provided for operation of the components of the separation system 10. Alternatively, single control units or various combinations of control units may be provided. The control system 60 may control operation of one or more of the following: the shredding unit 12, the sorting unit 40, the charging unit 20, the speed of the conveying system 45, the amount of additional charge applied by electrodes 30, and the amount of charging applied to the separation units 50-N.

Figure 2:
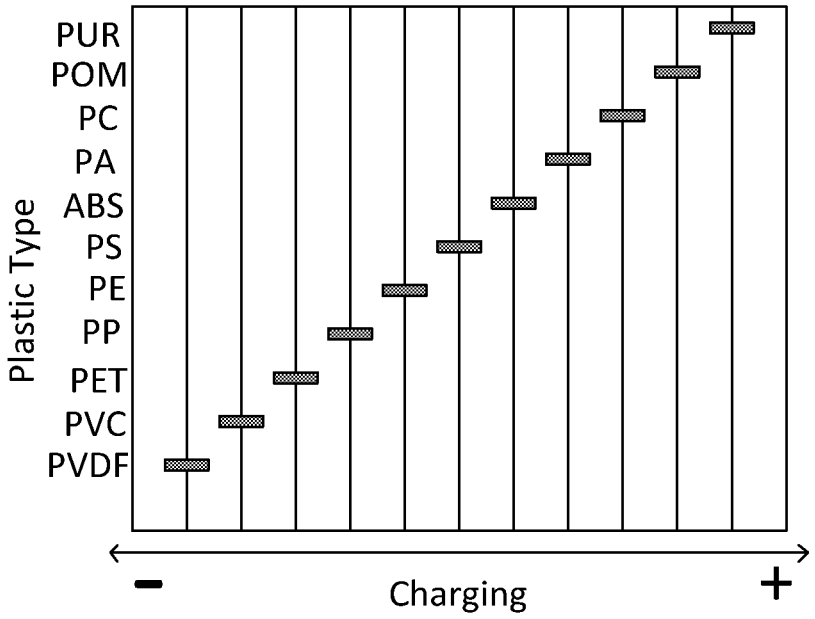
FIG. 2 depicts relative electrostatic charging characteristics of various plastics according to an embodiment.

Since different plastic types have different chargeability with respect to one another, the separation units 50-N may be configured to electrostatically attract individual plastic types from a mixture of plastic types. FIG. 2 depicts one representative illustration of relative chargeability of various types of plastics. The depicted plastics include: polyvinylidene fluoride (PVDF); polyvinyl chloride (PVC); polyethylene terephthalate (PET); polypropylene (PP); polyethylene (PE); polystyrene (PS); acrylonitrile butadiene styrene (ABS); polyamide (PA); polycarbonate (PC); polyoxymethylene (POM) and polyurethane (PUR). The relative charge achieved by the materials may be determined at the time of processing, as there are several parameters which may need to be taken into consideration, such as, surface area of the material, electric field intensity at the time of the charge, breakdown voltage of the air and time in the charging unit. The amounts of charge applied to the separation units to provide a differential appropriate for separation may, for example, range from hundreds of volts to tens of kilovolts to provide relative charging differences for separation of the plastics.

As will be discussed in greater detail further below with reference to various embodiments, the separation units 50-N may include a mechanism with an electrostatic body that takes a charge by charging with a pre-set amount of static electricity from an external source so as to be able to selectively cause a specific type of plastic to adhere to the charged portion according to various charging properties of the plastics. The electrostatic body may be charged with an opposite charge to that of the plastic pieces to thereby provide an electrostatic attraction between the pieces and the body. The plastics may be conveyed past the charged electrostatic body for selective separation of the plastic components and transport to a storage unit. The mechanism that selectively collects the separated plastic by type may be disposed above, below, or adjacent a pre-set position in the transport system and may have a configuration which crosses the movement direction of the transport unit.

When multiple separation units are used to selectively collect the separated plastic by type, in accordance with a desired need, such as the number of different types of plastics being sorted, at least the amount of charge on the charged portion in each separation unit may be set to be equal to, or to increase sequentially from the upstream side toward the downstream side in subsequent units along the transport system.

The mechanism that selectively collects the separated plastic by type may be disposed with a pre-set gap in relation to the plastic components, such that the mechanism in an overhead configuration is slightly above or barely makes contact with the surface of a plastic item that is being transported on the transport system. The mechanism may be charged with a pre-determined amount of static electricity so as to selectively cause a specific type of plastic to adhere to the charged portion according to the various charging properties of the multiple types of plastics passing by the electrostatic body. Thereafter, the selectively separated plastic may be transported to a collection area, or storage unit.

The mechanism that selectively collects the separated plastic by type may be a structure having a metallic surface, which may be iron, for example, and which may be coated with an electrically insulating material, such as ceramic. The charging conditions may be selectively set according to the plastics being separated. Further, as was previously discussed, the form (size) and charging of the plastics may also be selectively adjusted for the requirements of the system.

Figure 3:
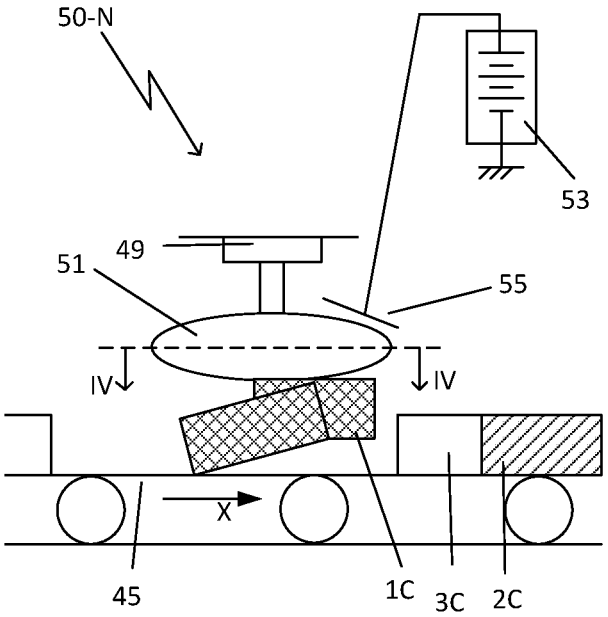
FIG. 3 depicts an electrostatic separation unit according to an embodiment.
Figure 4:
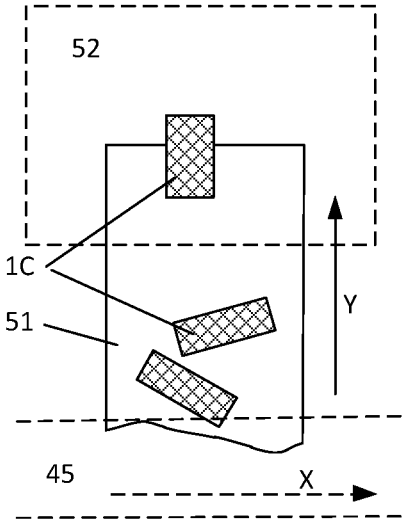
FIG. 4 is a view along line IV-IV of FIG. 3 according to an embodiment.

FIGS. 3 and 4 depict one type of separation unit 50-N which may be used as the separation units 50-1 and 50-2 in the separation system 10 of FIG. 1. For simplification of discussion, only three types of plastics 1, 2, 3 are shown. However, any number of types of plastic may be used within the scope of this disclosure, including two, or more than three. As previously discussed with reference to FIG. 1, the plastic components 1, 2, 3 may be cut-up to reduce the size, may be sorted to provide a uniformity of size, and charged in a charging system 20. The charged plastic components 1C, 2C, 3C may be deposited onto the conveying system 45 and transported in a direction towards and through the separation units 50-1, 50-2 which may be disposed above arbitrary midstream positions in the main transport system 45. In the embodiment shown, even though two collecting units are described, the number of units and locations at which the separating units are installed in relation to the transport system 45 may be selected as needed.

As shown in FIG. 3, each collecting unit 50-N may include a chargeable transporter 51. The transporter 51 may be formed from a plurality of suspended metallic carriers which move along a track or rail 49. The transporter 51 may be charged with static electricity from an externally provided high-voltage unit 53 via an electrode 55. The transporter 51 of each unit 50-N may be charged by its own corresponding high-voltage unit 53, or a single high-voltage unit may be used to charge multiple transporters, wherein appropriate controls may be provided to vary the charge to the transporters. The charge level for each transporter 51, taking into account the charging properties of static electricity in accordance with the various types of plastics as shown in FIG. 2, may be appropriately selected on the basis of the conditions in the usage environment, such as the type and form of collected plastics present, or the transport speed of the transporter. However, in a case in which two or more types of plastics are involved and two or more separation units 50-N are provided, at least the amount of charge on a transporter 51 should be set to increase from the upstream side (the first unit encountered—unit 50-1) toward the downstream side (the subsequent unit encountered—unit 50-2) in the main transport direction, so that the transporter 51 of the first separation unit 50-1 has the lowest charge, and each subsequent transporter of each subsequent separation unit 50-2 . . . 50-N, has incrementally greater charge.

With a configuration as described, a plastic having greater chargeability, such as polycarbonate, or those towards the top of the diagram in FIG. 2, may be attracted to a transporter 51 having a lower charge level, while plastics having less chargeability, such as polyvinyl chloride, or those towards the bottom of the diagram in FIG. 2, may be attracted to a subsequent transporter having a greater charge level.

In an embodiment wherein three types of plastics 1C, 2C, 3C are to be separated, such as is depicted in FIG. 1, the three types of plastics move along the transport system 45 to the first separation unit 50-1. At the unit 50-1, the transporter 51 may be charged with a sufficient level of static electricity to attract a first plastic type 1C, which may be polycarbonate, for example. The first plastic type 1C may be attracted to, and adhere to the surface of the charged transporter 51, while the remaining plastic components 2C and 3C pass through the unit 50-1. The charged transporter 51 may move in a direction Y different from, but intersecting with the direction X of the transport system 45, for example, as shown in FIG. 4, a direction perpendicular to the main transport direction, and may thus transport, or carry, the plastic components 1C attached to the surface of the charged transporter away from the transport system. The attached components 1C may then be deposited in a collection area 52.

A second separation unit 50-2, and any additional units 50-N, may be configured similarly to the first unit 50-1 so as to remove at least one additional plastic type from the conveyor system 45. In the configuration as shown in FIG. 1, wherein two additional plastic types, which, for example, may be polyethylene and polyvinyl chloride, pass through the first separation unit 50-1, the transporter 51 of the subsequent unit 50-2, may have a charge which is greater than the charge of the previous unit 50-1 and sufficient to remove plastic components 2C, which may be the polyethylene, for example, while leaving components 3C, which may be the polyvinyl chloride, for example, on the conveying system 45. The components 2C may be transported in a similar manner as components 1C to a respective collection area 54.

As shown in FIG. 1, the last plastic components 3C remaining on the conveying system 45, may be transported to a collection area 56 by the conveying system 45. Alternatively, an additional conveying system may be provided to take the components 3C from the system 45 to a desired collection area 56.

The level of charge applied to transporters 51 of the separation units 50-N, and the operating conditions, such as the size of the gap between the main transport system 45 and the charged transporter, may be appropriately decided on the basis of the combinations of the types, forms and treatment statuses of the plastic items to be separated and the transport speed, etc. of the transport system.

In an embodiment of a separation system 10, more than one separation unit 50-N may be needed for one type of plastic component. As an example, the plastics to be separated may have a significantly greater amount of one type of plastic component than a single separation unit 50-N may be able to handle at its optimum operating speed. In such a scenario, some of the plastic components may not adhere to the transporter 51 if the transporter is already covered with adhering plastic components, and thus pass through the collecting unit. A second, or possibly more, subsequent unit 50-(N+1) may then be needed that has the same charge as the previous unit instead of an increased charge as previously described.

Alternatively, a collection system 10 may be designed to have two or more similarly charged separation units for each type of plastic component to increase separation efficiency. In such an embodiment, for a particular type of plastic, any plastic components that are not picked up by the first unit may be picked up by the next unit, thereby providing a higher efficiency of separation.

Figure 5:
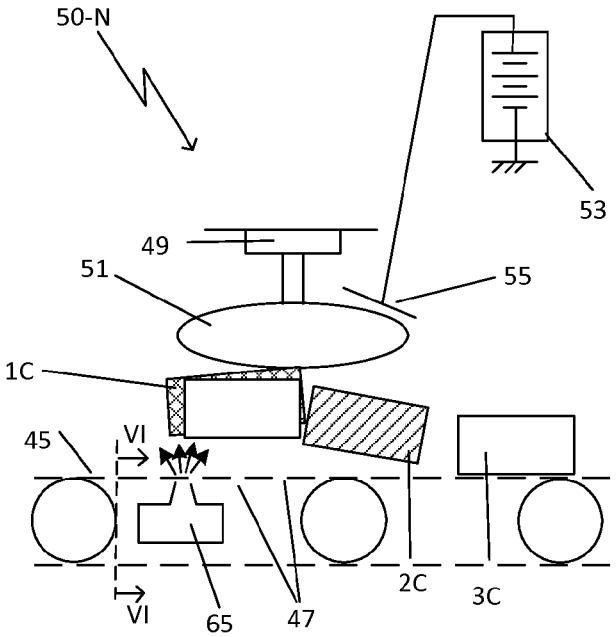
FIG. 5 depicts an alternate electrostatic separation unit according to an embodiment.
Figure 6:
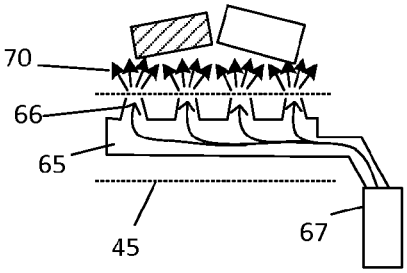
FIG. 6 is a view along line VI-VI of FIG. 5 according to an embodiment.

In an embodiment as depicted in FIGS. 5 and 6, a separation unit 50-N may include at least one air blower 65 to lift the plastic components 1C, 2C, 3C off of the conveying system 45 and direct them towards or into contact with the transporter 51. Such a configuration may improve the separation efficiency of the system by providing lift to the components to better enable the plastic components to contact, and if appropriate, adhere to the transporter 51. The blower 65 may be positioned just before the charged transporter 51 so as to blow the plastic items 1C, 2C, 3C off of the main transport system 45 and upwardly towards the transporter. This function may make the plastic items 1C, 2C, 3C come into contact with the surface of the charged transporter 51, enabling them to be better attracted thereto, thus providing a potential improvement in the separation efficiency.

The conveying system 45 may have spaced apart openings disposed along its length and width to allow the passage of air from the blowers 65 to reach the plastic pieces on the conveying system. The conveying system 45 may include a chain-link or mesh conveyor to provide air openings. The blower 65 may have a plurality of outlet nozzles 66 for dispersing the air upwardly though the plastic components, and may be fed by a blower source 67 which may be a fan, for example. The installation position of the blower 65, the number of blowing outlets 66, the air flow rate, and number of rows of outlets may be appropriately configured in accordance with the usage needs. FIG. 6 is a representative illustration of the blower of FIG. 5 as taken along VI-VI of FIG. 5. Air blower outlets 66 may be disposed in the upper part of the air blower main body 65, so that air blown out and through the transport system 45 suspends the plastic items 1C, 2C, 3C that are being transported via the main conveying system 45.

Figure 7:
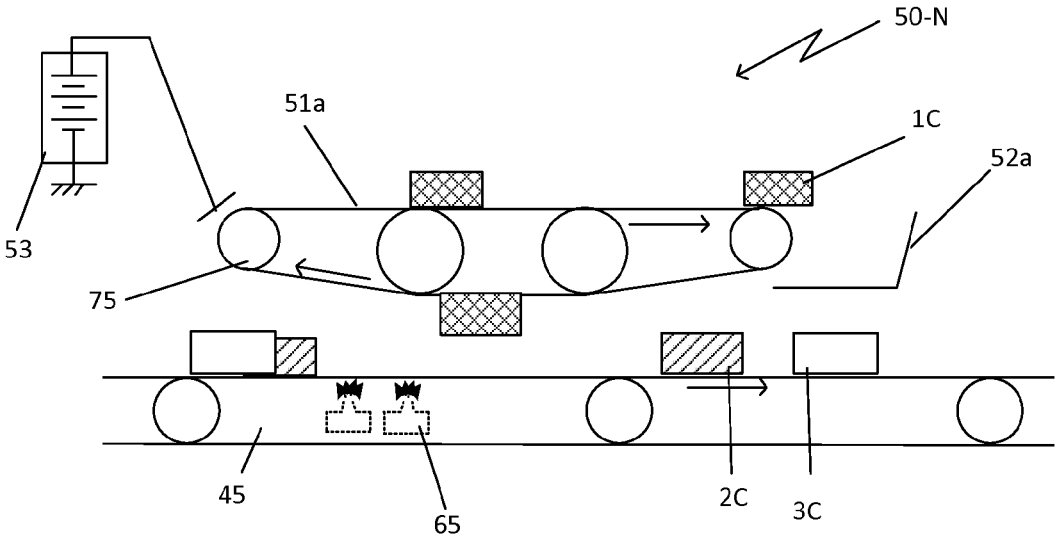
FIG. 7 depicts an alternate electrostatic separation unit according to an embodiment.

In an embodiment as depicted by FIG. 7, the chargeable carrier (51 in FIG. 3) of the separation units 50-N may alternatively be configured as a conveyor belt 51*a*, driven by a drive roller 75, and disposed above and substantially parallel with the main conveying system 45. A surface of the belt 51*a* may include chargeable portions to receive and carry the electrostatic charge opposite to the electrostatic charge given the charged components 1C, 2C, 3C to attract the charged components to the surface of the belt and adhere the charged components to the belt. The chargeable portions may be formed as metallic plates with a first surface engaging the belt and a second surface opposite the first surface and having a coating of insulating material for contact with the charged components 1C, 2C, 3C. The coating of insulating material may be a ceramic coating.

At least a portion of the belt 51*a* may be disposed in a spaced apart relationship above the conveyance path of conveying system 45 at a distance sufficient to permit attraction between the charged components and the oppositely charged belt to lift the charged components from the conveyance path to the surface of the belt. The lower portion of the carrier conveyor 51*a* that is disposed along the main conveying system 45 may be configured to move in a direction opposite to the direction of the main conveying system. With such a configuration, the plastic components 1C, 2C, 3C may be exposed to the charged carrier for a longer period of time to possibly provide a better opportunity for the appropriately charged plastic components to be attracted to and adhere to the carrier 51*a*. The carrier 51*a* may be a chargeable metallic belt or may be formed of other chargeable materials.

In an embodiment, the conveyor 51*a* may also be configured and disposed so that the lower portion thereof moves in the same direction as the movement direction of the transport system 45. With either direction of rotation, the carrier conveyor 51*a* may separate and remove at least one of the plastic components from others of the plastic components and transport the removed component to a collection area 52*a*. Additionally, one or more blowers 65 as previously discussed may also be provided, if desired, to introduce lift to the plastic components to move them to contact the carrier 51*a*.

Figure 8:
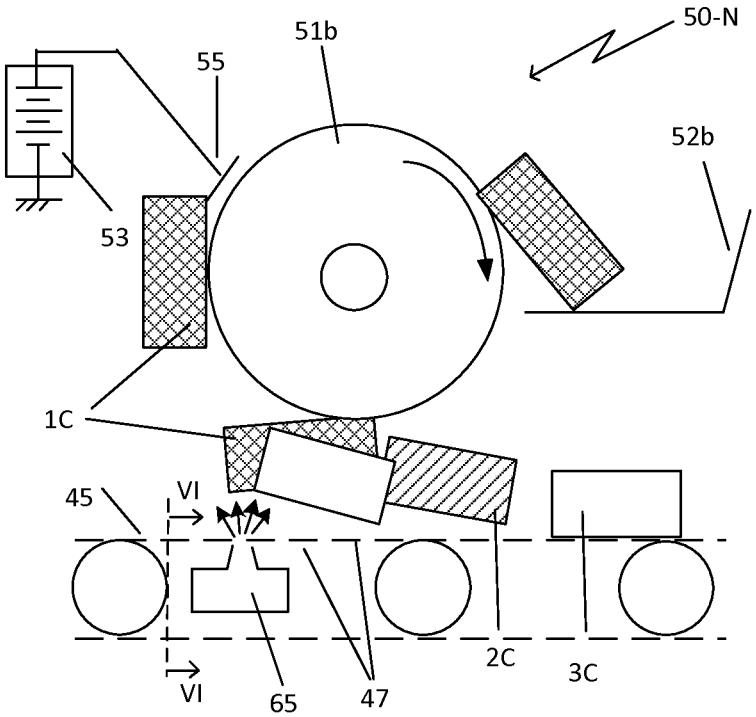
FIG. 8 depicts an alternate electrostatic separation unit according to an embodiment.

In an embodiment as depicted by FIG. 8, the chargeable carrier (51 in FIG. 3) of the separation units 50-N, may alternatively be configured as a rotating drum 51*b* suspended above the transport system 45. The surface of the drum 51*b* may be formed from a chargeable material, which may be a metal, such as iron, and may include a coating of an insulating material, such as ceramic, over the chargeable material. At least a surface of the drum 51*b* may carry the electrostatic charge opposite to the charge given the charged components 1C, 2C, 3C to attract the charged components to the surface of the drum and adhere the charged components to the drum. The drum 51*b* may be disposed in a spaced apart relationship above the conveying system 45 at a distance sufficient to permit attraction between the charged components 1C, 2C, 3C and the oppositely charged drum to lift the charged components from the conveyance path to the surface of the drum.

Similarly, as with previous embodiments, one or more blowers 65 may also be provided, if desired, to introduce lift to the plastic components to move the components towards, and/or into contact with the carrier drum 51*b*. Any plastic components adhered to the drum 51*b* may be carried by the rotating drum and deposited in a collection area 52*b*.

Figure 9:
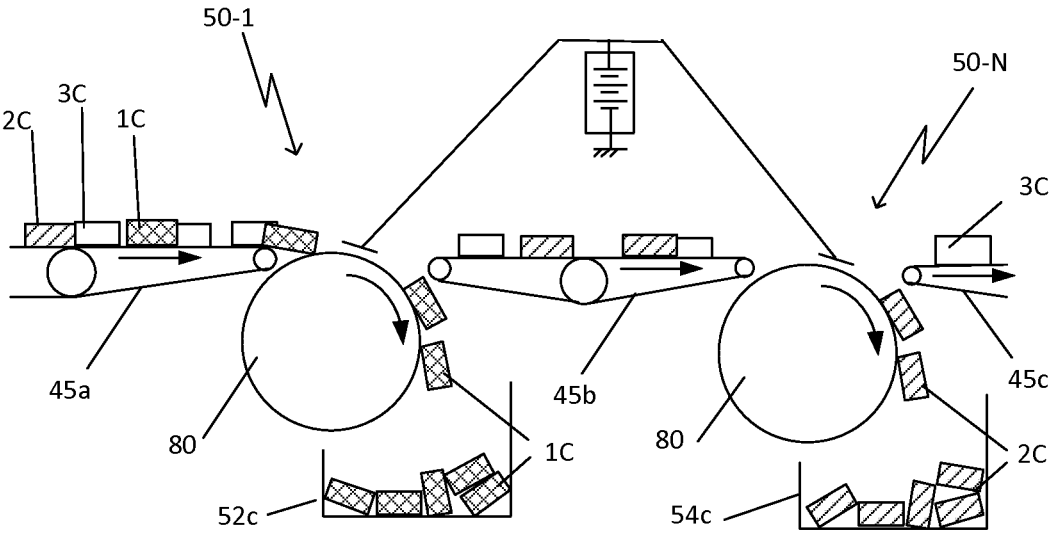
FIG. 9 depicts an alternate electrostatic separation unit according to an embodiment.

Another embodiment of the separation units 50-N and transport system 45 is depicted in FIG. 9. In a separation system 10 such as that of FIG. 1, the separation units 50-1 and 50-2 may include a rotating drum 80 which has a direction of rotation which is substantially in the direction the transport system 45. In such an embodiment, the transport system may be formed from several system components, which may include portions 45*a*, 45*b*, 45*c* and drums 80. The portions 45*a*, 45*b*, 45*c* may be formed from conveyor belt sections, as shown, or alternatively may be any other type of transport system, such as moving trays, or plates. With this type of embodiment, the plastic components may selectively adhere to the charged drum 80 and be dropped in a pre-determined direction perpendicular to the running direction of the transport system into a corresponding collection area 52*c*, 54*c*.

The unseparated plastic mixture of components 1C, 2C, 3C may be transported to the first separation unit 50-1 by a transport portion 45*a*. The drum 80 of unit 50-1 may be charged to a first extent sufficient to attract and retain plastic components 1C thereto. Rotation of the drum 80 will carry the plastic components between the conveying portions 45*a* and 45*b*, at which point further rotation may carry the retained components 1C downwardly into a collection area 52*c*, while pushing the unattached components 2C and 3C along onto the conveyer portion 45*b*, which may transport the components 2C and 3C to the next separation unit 50-2. The rotating drum 80 of unit 50-2 may be charged to an extent sufficient to attract and retain the plastic components 2C thereto to thereby separate the components 2C from components 3C. The components 3C may be passed along to the next conveyor section 45*c* while the components 2C retained on the drum are deposited in a collection area 54*c*.

Drums 80 may have a surface of metal, such as iron, and a covering of insulating material, such as ceramic. The combination of composition materials for the drums 80 may be any combination of conductive materials for the metal inner surface layer of the drum, and insulating materials for the outer surface layer, respectively. In an embodiment, the drums 80 may be set so that the outer circumference portions of the rotating drum are placed at the same level as the conveying portions 45*a*, 45*b*, 45*c* or possibly slightly above the conveying portions, with a substantial portion of the drums being disposed lower than the conveying portions.

Figure 10:
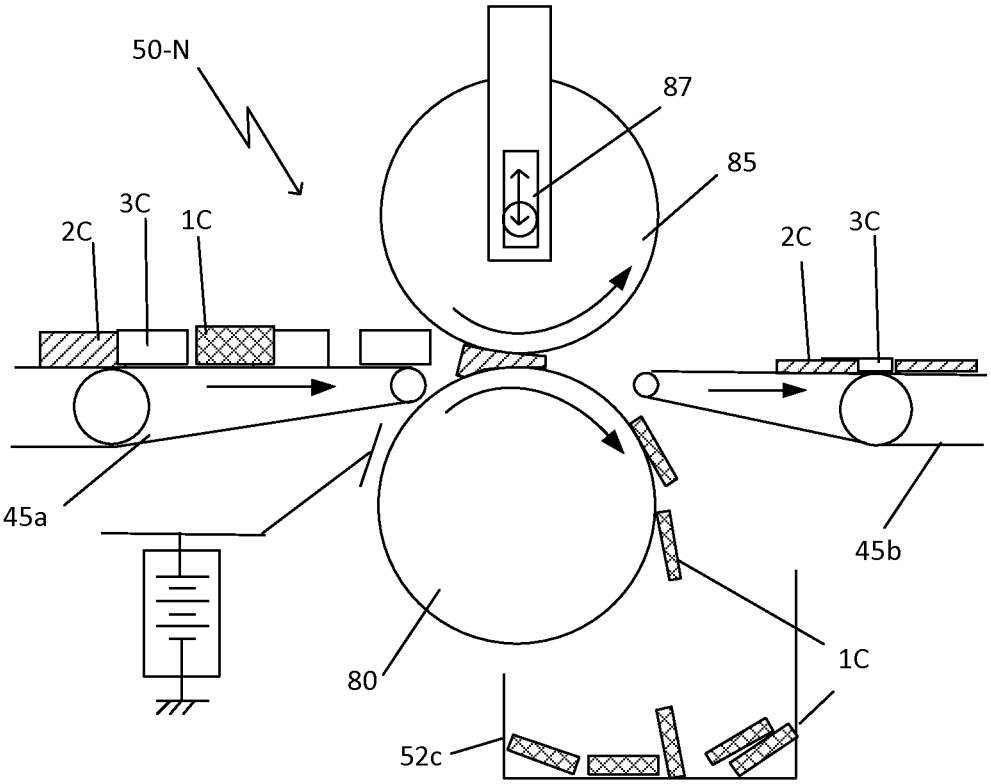
FIG. 10 depicts an alternate electrostatic separation unit according to an embodiment.

FIG. 10 depicts an additional embodiment of a separation unit 50-N which may be used in separation system 10 such as that depicted in FIG. 1. A separation unit 50-N, in addition to having the collection system as depicted in FIG. 9, may also include a mechanism which has a function of compressing the plastics that are being transported along the conveying system 45*a* to improve the collection rate. The compression system may include a compression drum 85 placed in opposition to the electrically chargeable drum 80. Alternatively, instead of having the compression drum rotate against the electrically chargeable drum 80, the compression drum may contact an additional drum in a similar manner, or the compression drum may contact the conveying system 45*a* if properly supported underneath to counter the applied pressure.

As shown in FIG. 10, the drums 80, 85 may rotate in opposite directions to provide a feed direction which is essentially the same as the direction of travel of the conveying system portions 45*a*, 45*b*. At least one of the drums may be configured with a height adjustment mechanism 87 which may allow for varying the distance between the two drums to vary the degree of compression and resultant thickness of the compressed plastic components 1C, 2C, 3C.

When plastic components 1C, 2C, 3C pass through between the compression drum 85 and the electrically charged rotating drum 80, the plastic components may be compressed on the electrically charged rotating drum by the compression drum, become selectively attached to the surface of the electrically charged rotating drum depending on their charging characteristics, as previously described, and be delivered to a collecting area 52*c*. As with the embodiment of FIG. 9, not all the plastics will attach to the electrically charged rotating drum 80. The attachment may depend on the combination of the charging characteristics between the electrically charged drum 80 and the plastic components 1C, 2C, 3C. The compression drum 85 may enhance the attachment of the attracted plastics on the surface of the electrically charged drum 80, and may improve the collection rate of the separation unit.

Various components of each embodiment described herein, may be used in combination with components from others of the embodiments described herein. For example, the separation units 50-N may all be of the same type. Alternatively, various ones of the separation units 50-N may be of a first type and others may be of a different type. Each of the separation unit embodiments may include a blower or a compression/compacting mechanism, and a location of the compression and compacting system may vary, and may be provided, for example, after shredding and before sorting, or after shredding and sorting and before charging, etc.

EXAMPLES

Example 1

System for Separation of a Three-Component Mixture of Plastics

A separation system 10, such as the system depicted in FIG. 1, will be established to separate recycled plastic components which include components formed from three different plastic types 1, 2, 3. A shredding unit 12 will be configured to shred the plastic components 1, 2, 3 to reduce the size of the components, and a sorting unit 40 will be provided to ensure uniformity of the size of the pieces 1A, 2A, 3A.

A frictional charging unit 20 will be used to agitate the pieces 1A, 2A, 3A and forcibly rub the pieces against each other to give the pieces an electrical charge. The drum 25 of the charging unit will be configured to output the charged pieces 1C, 2C, 3C directly onto a single conveyer 45. The conveyor 45 will be formed from an insulating material so as not to discharge the plastic pieces, and will be configured to carry the charged plastic pieces through two collecting units 50-1 and 50-2 disposed serially, one after the other along the conveyance path. Each of the collecting units 50-1 and 50-2 will have a chargeable transporter 51, and each transporter may be charged to an appropriate degree to attract different ones of the charged plastic pieces. The transporters 51 will be formed from a plurality of suspended metallic carriers having a coating of ceramic on the bottom surfaces thereof, and which will move along a track or rail 49 that runs perpendicular to the conveyor 45. The transporter 51 of each unit 50-1 and 50-2 will be configured in conjunction with a collection area 52, 54, respectively, to carry and deposit any separated plastic pieces into a corresponding collection area. An additional collection area 56 will be provided at the end of the conveyor 45 for receiving any plastic components which are not removed by the units 50-1 and 50-2.

Example 2

Separation of a Three-Component Mixture of Plastics

The separation system of Example 1 will be used to separate recycled plastic components which include components formed from polycarbonate 1, polyethylene 2, or polyvinyl chloride 3. The plastic components 1, 2, 3 will be fed into the shredding unit 12 which will be configured to shred the plastic components 1, 2, 3 to pieces having a size of about 100 $cm^2$ (approximately 10 cm by 10 cm). The pieces will be sorted in the sorting unit 40 to ensure that the size of the pieces 1A, 2A, 3A will be within +/−30% of the desired size.

Appropriately sized plastic pieces 1A, 2A, 3A will then be fed into and through the frictional charging unit 20 where they will be agitated to forcibly rub the pieces against each other to give the pieces an electrical charge. The charged pieces 1C, 2C, 3C will be directly discharged onto the conveyer 45 and will be transported to the first separation unit 50-1 of the two separation units.

Of the three plastic types, polycarbonate 1, polyethylene 2, and polyvinyl chloride 3, the polycarbonate will be charged to a greater degree than the other two upon emerging from the charging drum 25, and therefore, the chargeable transporter 51 in the first separation unit 50-1 will be charged to a degree sufficient to attract only the polycarbonate components 1C thereto. The charged plastic pieces 1C, 2C, 3C will pass under the charged moving transporter 51 of the first unit 50-1, and the polycarbonate pieces 1C will be the only pieces that have sufficient charge to be attracted to and adhere to the transporter. The pieces 1C will therefore lift off of the conveyor 45 and adhere to the transporter 51 while the remaining pieces 2C and 3C remain on the conveyor for transport those pieces to the next separation unit 50-2. The transporter 51 of the unit 50-1 will carry the separated polycarbonate pieces 1C to a designated collection area 52.

Of the remaining two plastic types, polyethylene 2C and polyvinyl chloride 3C, the polyethylene will charge to a greater degree than the polyvinyl chloride, and therefore, the chargeable transporter 51 in the second separation unit 50-2 will be charged to a degree sufficient to attract only the polyethylene components 2C thereto. The charged plastic pieces 2C, 3C will move under the charged moving transporter 51 of the unit 50-2, and the polyethylene pieces 2C will be the only pieces that have sufficient charge to be attracted to and adhere to the transporter. The pieces 2C will therefore lift off of the conveyor 45 and adhere to the transporter 51 while the remaining pieces 3C will remain on the conveyor and be transported to a collection area 56. The transporter 51 of the unit 50-1 will carry the polycarbonate pieces 1C to a designated collection area 52.

This disclosure is not limited to the particular systems, devices and methods described, as these may vary. The terminology used in the description is for the purpose of describing the particular versions or embodiments only, and is not intended to limit the scope.

In the above detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

As used in this document, the singular forms "a," "an," and "the" include plural references unless the context clearly dictates otherwise. Unless defined otherwise, all technical and scientific terms used herein have the same meanings as commonly understood by one of ordinary skill in the art. Nothing in this disclosure is to be construed as an admission that the embodiments described in this disclosure are not entitled to antedate such disclosure by virtue of prior invention. As used in this document, the term "comprising" means "including, but not limited to."

While various compositions, methods, and devices are described in terms of "comprising" various components or steps (interpreted as meaning "including, but not limited to"), the compositions, methods, and devices can also "consist essentially of" or "consist of" the various components and steps, and such terminology should be interpreted as defining essentially closed-member groups.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

Various of the above-disclosed and other features and functions, or alternatives thereof, may be combined into many other different systems or applications. Various presently unforeseen or unanticipated alternatives, modifications, variations or improvements therein may be subsequently made by those skilled in the art, each of which is also intended to be encompassed by the disclosed embodiments.

What is claimed is:

1. A system for sorting plastic components, the system comprising:

a charging device for giving each plastic component an electrostatic charge to produce charged components, wherein each plastic component comprises one of at least three different plastic types, and each plastic type obtains a different charge density than each other plastic type;

a collection area for collecting charged components of a first plastic type having a lowest charge density;

a conveying system for conveying the charged components along a conveyance path extending from the charging device to the collection area;

a plurality of electrostatic collectors disposed in series along the conveyance path, wherein the number of electrostatic collectors is greater than or equal to one less than the number of plastic types, each electrostatic collector being charged with an electrostatic charge opposite to the charge given the charged components to attract and adhere the charged components thereto and remove the adhered components from the conveyance path, wherein:

a first electrostatic collector has an amount of charge configured for attracting charged components of a second plastic type having a highest charge density; and each subsequent electrostatic collector has an amount of charge greater than the charge of a previous electrostatic collector and configured for attracting charged components of an additional plastic type having a next highest charge density.

2. The system of claim 1, further comprising a control system for altering the charge applied to each electrostatic collector to apply an appropriate charge to each electrostatic collector corresponding to a charge density of the plastic type of the charged components to be attracted to the electrostatic collector, and the plastic types are selected from polyvinylidene fluoride, polyvinyl chloride, polyethylene terephthalate, polypropylene, polyethylene, polystyrene, acrylonitrile butadiene styrene, polyamide, polycarbonate, polyoxymethylene and polyurethane.

3. The system of claim 1, further comprising a collection area associated with each electrostatic collector for receiving the adhered components from the associated electrostatic collector, and each electrostatic collector comprises a conveying arrangement for conveying the adhered components to the associated collection area.

4. The system of claim 1, wherein each electrostatic collector comprises a charged movable member disposed in relation to the conveyance path to attract and adhere the plastic components thereto and remove the adhered plastic components from the conveyance path upon movement of the movable member.

5. The system of claim 4, wherein the charged movable member comprises a rotating drum and at least a surface of the drum carries the electrostatic charge opposite to the charge given the charged components to attract the charged components to the surface of the drum and adhere the charged components to the drum.

6. The system of claim 5, wherein:

the drum is disposed in a spaced apart relationship above the conveyance path at a distance sufficient to permit attraction between the charged components and the oppositely charged drum to lift the charged components from the conveyance path to the surface of the drum;

the system further comprises a collection area associated with each electrostatic collector for receiving the adhered components from the associated electrostatic collector; and the drum is configured to carry the adhered components from the conveyance path to the associated collection area upon rotation of the drum.

7. The system of claim 5, wherein:

the drum is disposed substantially below the conveyance path with a portion of the surface of the drum being disposed above the conveyance path and forming a portion of the conveyance path for directly contacting charged components in the conveyance path for adherence of the charged components to the drum, the system further comprises a collection area associated with each electrostatic collector for receiving the adhered components from the associated electrostatic collector; and the drum is configured to carry the adhered components on the surface thereof from the conveyance path to the associated collection area upon rotation of the drum.

8. The system of claim 7, wherein:

the drum substantially below the conveyance path comprises a first rotating drum and the system further comprises a second rotating drum disposed at a distance above the first drum to compress the charged components as the charged components pass between the first drum and the second drum; and the first rotating drum comprises a surface of a conductive material coated with an electrically insulating material.

9. The system of claim 8, wherein the conductive material is iron and the electrically insulating material is ceramic.

10. The system of claim 4, wherein:

the charged movable member comprises a rotating belt; and at least a surface of the belt carries the electrostatic charge opposite to the electrostatic charge given the charged components to attract the charged components to the surface of the belt and adhere the charged components to the belt.

11. The system of claim 10, wherein:

at least a portion of the belt is disposed in a spaced apart relationship above the conveyance path at a distance sufficient to permit attraction between the charged components and the oppositely charged belt to lift the charged components from the conveyance path to the surface of the belt;

the belt is disposed transversely to the conveyance path;

the system further comprises a collection area associated with each electrostatic collector for receiving the adhered components from the associated electrostatic collector; and the belt is configured to carry the adhered components transversely away from the conveyance path to the associated collection area upon rotation of the belt.

12. The system of claim 10, wherein:

at least a portion of the belt is disposed above and in longitudinal alignment with the conveyance path for attracting charged components thereto;

the portion of the belt is substantially parallel to the conveyance path;

the conveyance path defines a first direction from the charging device to the collection area for collecting the charged components of the first plastic type;

the portion of the belt substantially parallel to the conveyance path moves in a direction opposite to the first direction;

the system further comprises a collection area associated with each electrostatic collector for receiving the adhered components from the associated electrostatic collector; and the belt is configured to carry the adhered components upwardly away from the conveyance path to the associated collection area upon rotation of the belt.

13. The system of claim 4, wherein:

the charged movable member comprises a rotating belt; and a surface of the belt comprises chargeable portions to receive and carry the electrostatic charge opposite to the electrostatic charge given the charged components to attract the charged components to the surface of the belt and adhere the charged components to the belt.

14. The system of claim 13, wherein:

the chargeable portions comprise metallic plates with a first surface engaging the belt and a second surface opposite the first surface; and the second surface comprises a coating of ceramic insulating material for contacting the charged components.

15. The system of claim 1, further comprising a compacting arrangement for compacting the plastic components prior to charging of the plastic components, the compacting arrangement comprising:

a first roller; and a second roller disposed adjacent and spaced apart from the first roller at a distance from the first roller sufficient to compress the plastic components as the plastic components pass between the first roller and the second roller.

16. The system of claim 1, wherein the plastic components have a size and the system further comprises at least one of a cutting mill, a hammer mill or a shredder for reducing the size of the plastic material prior to charging of the plastic material.

17. The system of claim 1, wherein:

the conveying system comprises at least one of:

at least one conveyor belt; and at least one tray movable along the conveyance path; and the charging device comprises at least one of:

a contact electrification device for agitating and frictionally charging the plastic components; and a discharge electrification device for charging the plastic components.

18. The system of claim 17, wherein:

the contact electrification device comprises a substantially cylindrical container having a first end for receiving the components, a second end for discharging the charged components to the conveying system, and an agitator comprising a plurality of rod members radially attached to a shaft rotating about the center of the container to agitate and frictionally charge the plastic components as the plastic components move from the first end to the second end; and the discharge electrification device comprises a corona discharge for applying a high voltage charge to the plastic components.

19. The system of claim 1, wherein:

the conveying system comprises a belt having a plurality of openings disposed across a width and length of the belt; and the system further comprises:

at least one blower having at least one blower output disposed below the belt proximate each electrostatic collector for blowing air upwardly through the belt to lift the charged components and lifting the charged components off of the conveying system towards the electrostatic collector.

20. A method for sorting plastic components, the method comprising:

determining the number and kinds of plastic types of the plastic components, wherein each plastic component comprises one of at least three different plastic types;

charging each plastic component with an electrostatic charge to produce charged components, wherein each plastic type charges to a different charge density than each other plastic type;

conveying the charged components along a conveyance path extending from the charging device to a first collection area;

disposing a plurality of electrostatic collectors in series along the conveyance path, the number of electrostatic collectors being greater than or equal to one less than the number of plastic types;

charging each of the plurality of electrostatic collectors with an electrostatic charge opposite to the electrostatic charge given to the charged components and configured as a function of the plastic type to attract the charged components to the electrostatic collectors and adhere the charged components to the electrostatic collectors to remove the adhered components from the conveying device, the charging comprising:

charging a first electrostatic collector with an amount of charge configured for attracting charged components of a first plastic type having a highest charge density, and charging each subsequent electrostatic collector with an amount of charge greater than the charge of a previous electrostatic collector and configured for attracting charged components of an additional plastic type having a next highest charge;

removing the charged components of the first plastic type from the conveyance path with the first electrostatic collector;

removing the charged components of the additional plastic type from the conveyance path with each subsequent electrostatic collector; and collecting components of a second plastic type having the lowest charge density in the first collection area.

21. The method of claim 20, wherein the plastic types are selected from polyvinylidene fluoride, polyvinyl chloride, polyethylene terephthalate, polypropylene, polyethylene, polystyrene, acrylonitrile butadiene styrene, polyamide, polycarbonate, polyoxymethylene and polyurethane, and the method further comprises altering the charge applied to each electrostatic collector to apply an appropriate charge to each electrostatic collector corresponding to the charge density of the plastic type to be attracted to the electrostatic collector.

22. The method of claim 20, wherein:

removing the charged components of the first plastic type further comprises conveying the charged components of the first plastic type to a second collection area and depositing the charged components in the second collection area; and removing the charged components of the additional plastic type by subsequent electrostatic collectors further comprises conveying the charged components to additional collection areas associated with each subsequent electrostatic collector and depositing the charged components in the associated collection areas.

23. The method of claim 20, wherein each electrostatic collector comprises a charged movable member disposed in relation to the conveyance path, and the method further comprises:

moving at least a portion of the charged movable member into a vicinity of the charged components;

attracting charged components to the charged movable member;

adhering the attracted components to the charged movable member; and moving the adhered components away from the conveying system with the charged movable member.

24. The method of claim 23, wherein the charged movable member comprises a rotating drum, and the method further comprises:

charging a surface of the drum with the charge opposite to the charge of the charged components;

attracting the charged components to the surface of the drum to adhere the charged components to the surface of the drum; and conveying the adhered components by rotation of the drum.

25. The method of claim 24, wherein a collection area is associated with each electrostatic collector for receiving the adhered components from the associated electrostatic collector, and the method further comprises:

placing the drum above the conveyance path;

adjusting a distance between the drum and the charged components as a function of the size of the charged components, the charge on the drum and the charge on the charged components to permit attraction between the charged components and the oppositely charged drum to lift the plastic components from the conveyance path to the surface of the drum; and rotating the drum to carry the adhered components from the conveyance path to the associated collection area.

26. The method of claim 24, wherein a collection area is associated with each electrostatic collector for receiving the adhered components from the associated electrostatic collector, and the method further comprises:

placing the drum substantially below the conveyance path with a portion of the surface of the drum extending slightly above the conveyance path to form a portion of the conveyance path;

transporting the charged components along the conveyance path and onto the drum;

contacting and adhering charged components of one of the plastic types to the surface of the drum, wherein components of other plastic types fail to adhere to the surface of the drum; and rotating the drum to carry the adhered charged components downwardly away from the conveyance path to the associated collection area and pass non-adhering components along the conveyance path.

27. The method of claim 26, wherein the drum disposed substantially below the conveyance path comprises a first rotating drum, and the method further comprises:

placing a second rotating drum at a distance above the first drum sufficient to compress the charged components as the charged components pass between the first and second drums; and compressing the charged components between the first and second rotating drums.

28. The method of claim 23, wherein the charged movable member comprises a rotating belt having a surface for attracting the charged components, and the method further comprises:

charging at least a portion of the surface of the belt with the electrostatic charge opposite to the charge given the charged components; and attracting the charged components to the surface of the belt to adhere the charged components to the belt.

29. The method of claim 28, wherein a collection area is associated with each electrostatic collector for receiving the attracted components from the associated electrostatic collector, and the method further comprises:

passing at least a portion of the rotating belt above the conveyance path by at least one of:

disposing the rotating belt transversely to the conveyance path to carry adhered charged components from the conveyance path to the collection area associated with each electrostatic collector; and disposing at least a portion of the rotating belt in longitudinal alignment with the conveyance path with the portion of the belt facing and substantially parallel to the conveyance path wherein the conveyance path defines a first direction from the charging device to the collection area for collecting the charged components of the first plastic type;

attracting and adhering charged components to the portion of the belt above the conveyance path;

adjusting a distance between the surface of the portion of the belt and the charged components as a function of the size of the charged components, the charge on the surface of the belt and the charge on the charged components to permit attraction between the charged components and the oppositely charged belt to lift the charged components from the conveyance path to the surface of the rotating belt; and operating the rotating belt to carry adhered charged components away from the conveyance path to the associated collection area.

30. The method of claim 20, wherein the plastic components have a size and the method further comprises at least one of:

compacting the plastic components prior to charging of the plastic components by passing the plastic components between a first roller and a second roller disposed at a distance from the first roller sufficient to compress the plastic components as the plastic components pass between the first and second rollers; and diminishing the size of the plastic components prior to charging of the plastic components by at least one of cutting, shredding and milling of the plastic components.

31. The method of claim 20, wherein the charging further comprises:

comminuting the plastic components;

feeding the comminuted plastic components into a container comprising a substantially cylindrical container having a first end for receiving the plastic components, a second end for discharging the charged components to the conveying system and an agitator comprising a plurality of rod members radially attached to a shaft rotating about the center of the container agitating the plastic components in the container to frictionally engage and charge the plastic components and move the plastic components from the first end to the second end; and discharging the charged components from the second end onto the conveying system.

32. The method of claim 20, wherein the conveying system comprises a belt having a plurality of openings disposed across a width and length of the belt, and the method further comprises blowing air upwardly through the belt to lift the components from the belt towards the electrostatic collector.

* * * * *